114-253 SR
7/26/77 XR 4,037,555

United States Patent [19]

Berman

[11] 4,037,555

[45] July 26, 1977

[54] BUOY RECOVERY TECHNIQUE

[76] Inventor: Myer Berman, 14527 Woodcrest Drive, Rockville, Md. 20853

[21] Appl. No.: 701,487

[22] Filed: June 30, 1976

[51] Int. Cl.[2] ..... B63B 21/56

[52] U.S. Cl. ..... 114/245; 114/253

[58] Field of Search ..... 114/235 R, 235 B, 51, 114/242, 253, 244, 245; 9/8 R, 9; 294/66 R

[56] References Cited

U.S. PATENT DOCUMENTS

| | | | |
|---|---|---|---|
| 1,824,694 | 9/1931 | Stave | 114/51 X |
| 2,594,120 | 4/1952 | Busher | 294/66 R X |
| 3,469,551 | 9/1969 | Lefebvre | 114/235 R |
| 3,866,561 | 2/1975 | Sieber | 114/235 B |

*Primary Examiner*—Trygve M. Blix
*Assistant Examiner*—Sherman D. Basinger
*Attorney, Agent, or Firm*—R. Sciascia; R. Beers; S. Sheinbein

[57] ABSTRACT

The recovery of buoys by a helicopter or a ship is accomplished by sweeping a grapnel therefrom underwater until it engages a suitable receptacle attached to the buoy mooring cable. Once engaged, the buoy is then winched aboard the helicopter or ship.

3 Claims, 4 Drawing Figures

BUOY RECOVERY TECHNIQUE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to methods of recovering devices from a fluid medium, and more particularly to recovering buoys from water by using a grapnel deployed from a helicopter or ship.

Heretofore, recovery of a buoy from the water by a helicopter has been extremely difficult requiring the lowering of a man from the helicopter to attach a line to the buoy. Recovery of mine countermeasures gear, as well as buoys, has generally been accomplished exclusively by ship. Buoys are generally secured in position by a chain or cable which connects the buoy to an anchor. Current recovery techniques involve maneuvering a ship alongside the buoy to be recovered and hooking it with a shepherd's hook, or deploying a small boat to tow a line to the buoy. Other methods have used hooks towed behind a boat to hook the buoy mooring cable to move the buoy to a new location. In higher sea states (sea state three and higher) it is extremely difficult and hazardous to recover buoys, and it is an established fact that ships cannot recover buoys in sea states exceeding sea state three due to the hazard to personnel.

Since buoys are used extensively as navigational aids and as markers for the location of various underwater objects, it is desirable to have a method for recovering and relocating buoys without manual intervention, with its attendant risks.

SUMMARY OF THE INVENTION

Accordingly, the present invention provides a method and apparatus for recovering buoys by helicopter or by ship, even in high sea states. The buoy recovery gear uses floats and kites rigged as depressors and diverters. A sweep-wire is fitted between the kites with a grapnel attached to it. The grapnel is then towed underwater from the helicopter or ship to engage a grapnel receiving ring previously attached to a buoy mooring cable, and the buoy is then hauled from the water.

OBJECTS OF THE INVENTION

It is therefore an object of the present invention to provide for recovering buoys by a helicopter.

A further object of the present invention is to provide for recovering buoys without manual intervention.

Another object of the present invention is to provide for recovering buoys by ships in sea state three and above.

Still another object of the present invention is to provide an attachment to buoy mooring cables to facilitate the recovery of buoys.

Yet another object of the present invention is to provide for recovering buoys while reducing the hazard to personnel.

A still further object of the present invention is to provide for engaging a buoy mooring cable under the surface of the water at a predetermined depth.

Another object of the present invention is to provide for recovering and relocating buoys at nominal cost.

BRIEF DESCRIPTION OF THE DRAWINGS

Other objects and many of the attendant advantages of the present invention will be readily apparent as the invention becomes better understood by reference to the following detailed description with the appended claims, when considered in conjunction with the accompanying drawings, wherein:

FIG. 3(*b*) is a side view of the grapnel receiving ring of FIG. 3(*a*).

DESCRIPTION OF THE PREFERRED EMBODIMENT

Figure 1:
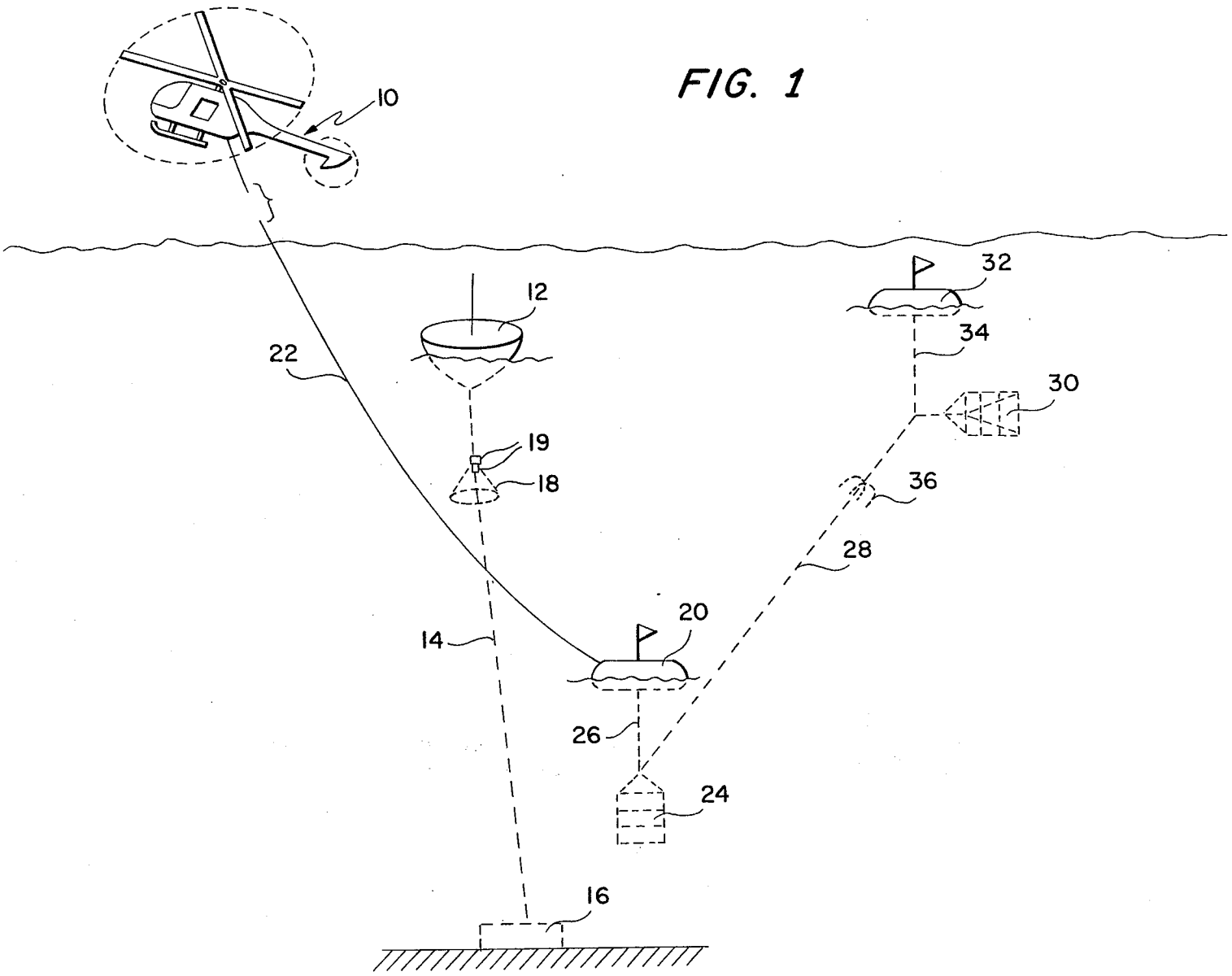
FIG. 1 is a pictorial view of the deployment of the buoy recovery gear.

Referring now to the drawings, wherein like reference characters designate like or corresponding parts throughout the several views, FIG. 1 shows a tow vehicle 10 such as a helicopter, ship or the like, to which is connected the buoy recovery gear. The buoy 12 to be recovered is connected by a buoy mooring cable 14 to an anchor 16 which holds the buoy in its position. A grapnel receiving ring 18 is attached to the buoy mooring cable 14 beneath the surface of the water and held in place between two wedge stops 19.

The buoy recovery gear has a first float 20 which is connected by a tow cable 22 to the tow vehicle 10. A kite 24 rigged as a depressor is connected to the first float 20 by line 26. A second float 32 is connected to a diverter 30 by line 34. A sweep wire 28 is run between depressor 24 and diverter 30 so that when towed, the sweep wire will make contact with the buoy mooring cable 14 beneath the grapnel receiving ring 18. A grapnel 36 is attached to the sweep wire 28 midway but slightly nearer diverter 30 between the depressor 24 and the diverter 30 in such a manner that when the sweep wire slips across the buoy mooring cable 14, the grapnel will slide up cable 14 and engage the grapnel receiving ring 18.

As the buoy recovery gear is towed through the water by the tow vehicle 10, the sweep wire 28 is maintained at such a depth by the depressor 24 so that it will cross the buoy mooring cable 14 below the grapnel receiving ring 18. Diverter 30 maintains a separation between first float 20 and second float 32 so that the sweep wire is assured of crossing buoy mooring cable 14.

Figure 2:
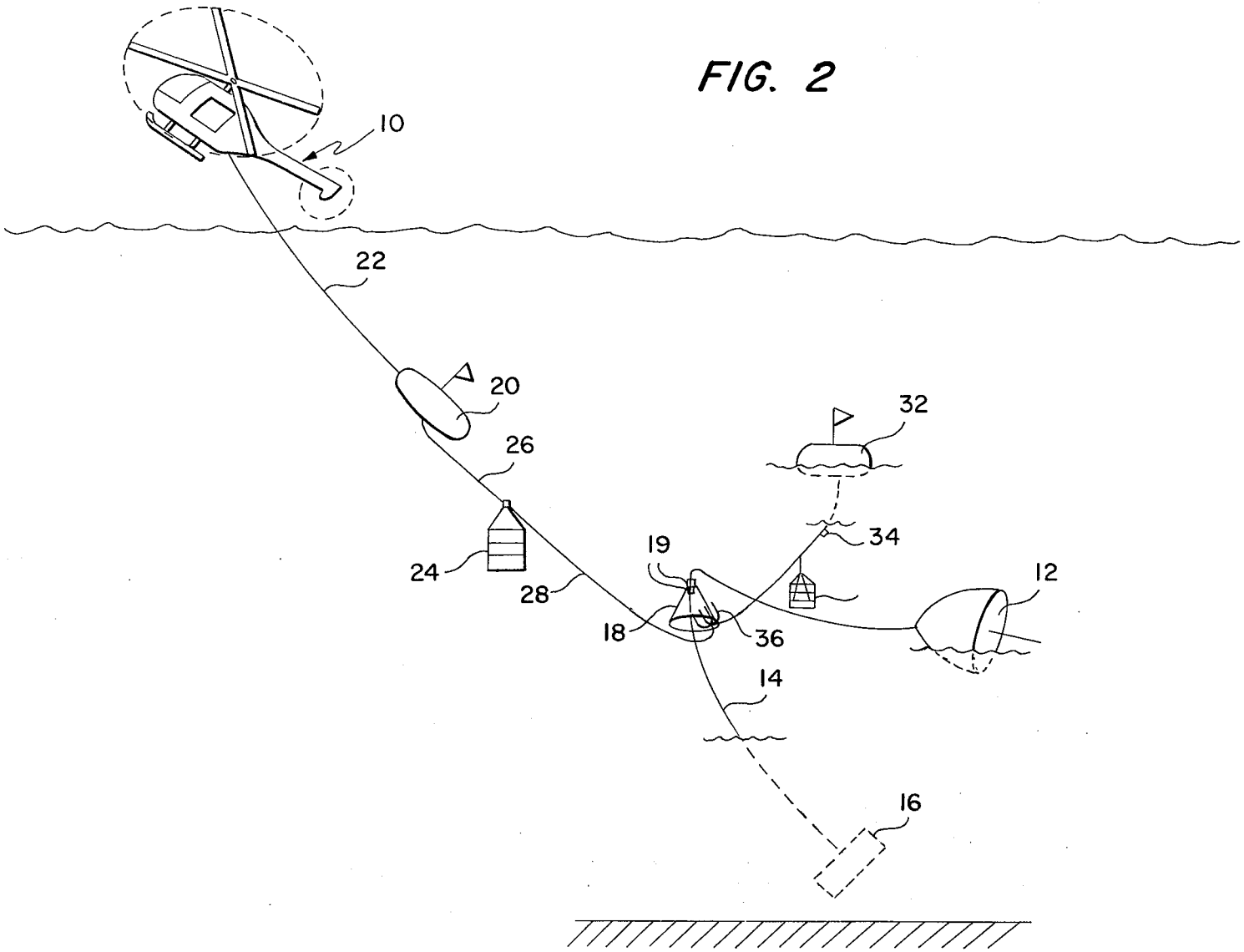
FIG. 2 is a pictorial view of the buoy recovery gear after engagement with the buoy mooring cable.

Referring now to FIG. 2, after the sweep wire 28 crosses and contacts the buoy mooring cable 14, they will slide against each other until grapnel 36 contacts the cable and slides up it to engage the grapnel receiving ring 18. At this point the tow vehicle 10 can start to winch in the buoy recovery gear and the buoy 12 with its associated components to complete the buoy recovery operation.

Figure 3A:
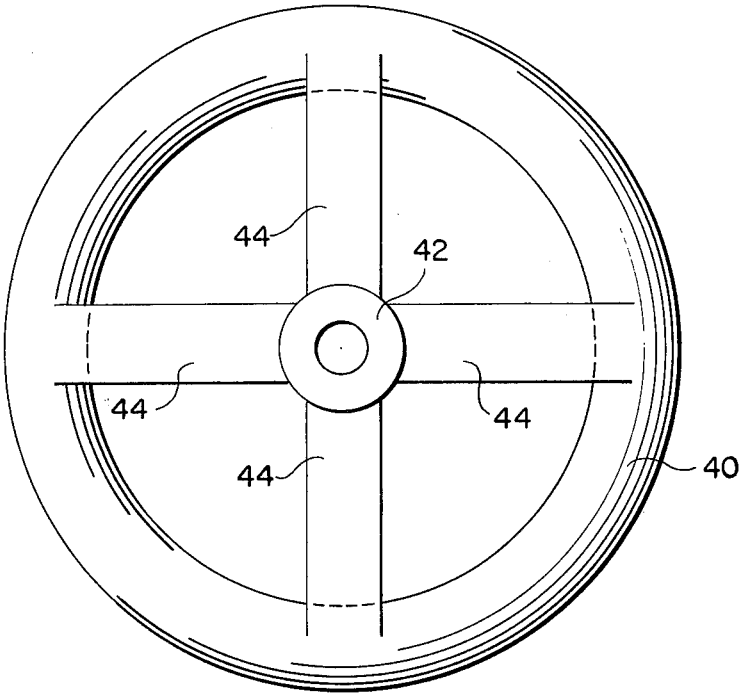
FIG. 3(*a*) is a top view of the grapnel receiving ring.
Figure 3B:
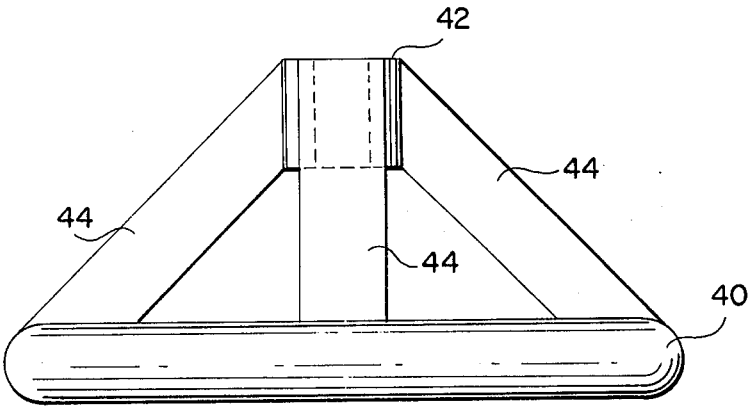

Referring now to FIG. 3(*a*) and 3(*b*), the grapnel receiving ring 18 has a tubular ring 40. A collar 42, which lies in a plane parallel to and concentric with the ring 40, is connected to the ring by four struts 44 to form a rigid structure. As previously described, the grapnel receiving ring 18 is attached to a buoy mooring cable by wedge stops 19 that grapnel 36 can securely engage the receiving ring.

Therefore, it is apparent that the disclosed method for recovering buoys is a simple technique employing currently available equipment which can be used by helicopters or ships without manual intervention and, therefore, without hazard to personnel, even in high sea states where such recovery was previously not possible.

Obviously, other embodiments and modifications of the present invention will readily come to those of ordinary skill in the art having the benefit of the teachings presented in the foregoing description and the drawings. It is, therefore, to be understood that this invention is not to be limited thereto and that said modifications and embodiments are intended to be included within the scope of the appended claims.

What is claimed and desired to be secured by Letters Patent of the United States is:

1. Apparatus for recovery of moored buoys having a buoy mooring line in a fluid medium from a moving vehicle comprising:

a first float;

a depressor connected to said first float;

a second float;

a diverter connected to said second float;

a sweep wire connected between said depressor and said diverter to sweep through the fluid medium in a sweep area defined by said diverter;

a grapnel attached to said sweep wire for engaging a buoy mooring line to which the buoy to be recovered is attached; and a grapnel receiving ring attached to said buoy mooring line between a pair of wedge stops for engaging said grapnel;

whereby when said apparatus is towed from said moving vehicle said grapnel engages said buoy mooring line enabling recovery of said buoy.

2. Apparatus for recovery of buoys as described in claim 1 wherein the moving vehicle is airborne.

3. Apparatus for recovery of buoys as described in claim 1 wherein said grapnel receiving ring comprises:

a tubular ring;

a collar lying in a plane parallel to and concentric with said tubular ring and connected thereto by a plurality of struts to form a rigid structure.

* * * * *